US005964978A

United States Patent [19]

Hirooka

[11] Patent Number: 5,964,978

[45] Date of Patent: Oct. 12, 1999

[54] METHOD AND APPARATUS FOR ADHESION OF SEMICONDUCTOR SUBSTRATE

[75] Inventor: Hideoki Hirooka, Fukushima-ken, Japan

[73] Assignee: Shin-Etsu Handotai Co., Ltd., Tokyo, Japan

[21] Appl. No.: 09/044,080

[22] Filed: Mar. 19, 1998

[30] Foreign Application Priority Data

Mar. 31, 1997 [JP] Japan ..... 9-081642

[51] Int. Cl.[6] ..... B32B 31/00

[52] U.S. Cl. ..... 156/299; 156/285; 156/580

[58] Field of Search ..... 156/285, 286, 156/295, 580, 583.3, 382, 102, 105, 60, 299, 578, 153; 100/122; 269/22, 153, 154, 903; 29/743; 438/106, 118; 148/DIG. 12, DIG. 135, DIG. 138

[56] References Cited

FOREIGN PATENT DOCUMENTS

WO 87/01651 3/1987 France .

62-71215 4/1987 Japan .

A-64-10643 1/1989 Japan .

1171360 7/1985 U.S.S.R. .

*Primary Examiner*—Michael W. Ball

*Assistant Examiner*—Barbara J. Musser

*Attorney, Agent, or Firm*—Oliff & Berridge, PLC

[57] ABSTRACT

A method and apparatus for adhesion of a semiconductor substrate on a support block in a condition that there are no minute concave or convex portions on the semiconductor substrate are proposed and have features that not only is the semiconductor substrate supported at its periphery in a squeezing condition but a back pressure is also applied on the semiconductor substrate with an air bag in such a manner that a region of the air bag corresponding to the central region of the semiconductor substrate is most swelled out, so that the semiconductor substrate is curved and the central region of the semiconductor substrate is pressed to the support block and thereafter, the squeezing condition of the semiconductor substrate is released to make the semiconductor substrate adhered to the support block.

3 Claims, 6 Drawing Sheets

METHOD AND APPARATUS FOR ADHESION OF SEMICONDUCTOR SUBSTRATE

BACKGROUND OF THE INVENTION

1. Field of the Invention

The present invention relates to a method and apparatus for adhesion of a semiconductor substrate in order to make a semiconductor substrate adhere to a support block with an adhesive.

2. Related Art

In recent years, a trend of super-integration of a semiconductor integrated circuit has been accelerated and in company with the trend, not only has a semiconductor substrate been larger in diameter, but miniaturization in a semiconductor device has also progressed toward to a finer design rule. For this reason, requirement for a flatness of a semiconductor substrate has increasingly been severer.

A flatness of a semiconductor substrate is dependent on an adhesion accuracy of a semiconductor substrate to a support block (pressure plate) in polishing of the semiconductor substrate. There has conventionally been conceived an adhesion method as described in Publication of Unexamined Japanese Patent Application No. 64-10643.

The adhesion method will be described in reference to FIG. 8. In the adhesion method, an adhesive material 23, such as wax, an adhesive or the like, is applied on a semiconductor substrate 21 or a support block 22 of a polishing apparatus, the semiconductor substrate 21 is vacuum chucked on a porous suction plate 25 made of ceramics or the like which is mounted to a suction member 24, the semiconductor substrate 21 is pressed on the support block 22 while the support block 22 is heated and the adhesive material 23 is maintained in a molten state and thereafter, vacuum suction is broken. A suction surface of the suction plate 25 used in this case is a spherical surface.

There has been an established understanding on the following effects thereof according to such a method.

The method is conducted in the following way: the semiconductor substrate 21 is pressed on the support block 22 and vacuum chucking of the semiconductor substrate 21 is broken, in other words, the semiconductor substrate 21 is released from a curved condition while the semiconductor substrate 21 is pressed, thereby the semiconductor substrate 21 changes a profile of the current curved surface and the surface gradually restores its original flat one while the restoration progresses from the central region to its periphery along a radial direction or from one region to another region along one direction so that, for example, a surface of the semiconductor substrate 21 pressing the support block 22 grows to a larger circle area from a small one at its center as a starting. Therefore, even when bubbles are mixed in the adhesive material 23, the bubbles are pressed out radially or along the one direction. If the curved condition of the semiconductor substrate 21 is released in the above mentioned manner, a pressing force is kept constant including a restored surface area in a radial direction or in one direction in the course of restoration of the original profile. Therefore, mixing-in of bubbles to an adhesive material is effectively prevented.

In the above mentioned method, however, since a porous suction plate 25 is used, minute concave or convex portions arise on the semiconductor substrate 21, which is vacuum chucked. Therefore, mixing-in of bubbles to the adhesive material 23 is unavoidable when the semiconductor substrate 21 is pressed on the support block 22. Moreover, part of the bubbles remains in the adhesive material 23 after adhesion of the semiconductor substrate 21 to the support block 22 is finished. As a result, part of the minute concave or convex portions are transferred on the semiconductor substrate 21, which has caused a problem of reduction in flatness level.

SUMMARY OF THE INVENTION

The present invention has been made in light of such a fault and it is an object of the present invention to provide a method and apparatus for adhesion of a semiconductor substrate on a support block in a condition of being free from concave or convex portions on a surface of the semiconductor substrate.

A first aspect of the present invention is directed to an adhesion method for a semiconductor substrate on a support block with an adhesive material, is characterized in that not only is the semiconductor substrate supported at its periphery in a squeezing condition but a back pressure is also applied on the semiconductor substrate with an air bag in such a manner that a region of the air bag corresponding to the central region of the semiconductor substrate is most swelled out, so that the semiconductor substrate is curved and the central region of the semiconductor substrate is pressed to the support block and that thereafter, the squeezing condition of the semiconductor substrate is released to make the semiconductor substrate adhered to the support block.

According to this adhesion method, since the semiconductor substrate is curved by applying the back pressure with the air bag and thereby minute concave or convex portions do not arise on the semiconductor substrate, which is different from the case where vacuum chucking is employed, bubbles are hard to be mixed in the adhesive material. As a result, a flatness level after polishing is improved.

A second aspect of the present invention is directed to an adhesion method for a semiconductor substrate on a support block with an adhesive material, is characterized in that the semiconductor substrate is supported at its periphery in a squeezing condition, that the squeezing condition of the semiconductor substrate is released to have the semiconductor substrate fall on the support block by its self weight, that thereafter a back pressure is applied on the semiconductor substrate with an air bag in such a manner that a region of the air bag corresponding to the central region of the semiconductor substrate is most swelled out and that thereby the semiconductor substrate is made to adhere to the support block.

According to this adhesion method, since the semiconductor substrate is made to adhered to the support block by a process in which the semiconductor substrate is held at its periphery in a squeezing condition, the squeezing condition of the semiconductor substrate is released to have the semiconductor substrate fall on the support block by its self weight and a back pressure is applied on the semiconductor substrate with an air bag, and thereby minute concave or convex portions do not arise on the semiconductor substrate, which is different from the case where vacuum chucking is employed, bubbles are hard to be mixed in the adhesive material. As a result, a flatness level after polishing is improved.

A third aspect of the present invention is directed to an adhesion apparatus for a semiconductor substrate on a support block with an adhesive material, comprising: a chuck for holding the semiconductor substrate at its periphery in a squeezing condition; chuck drive means for driving the chuck to convert the squeezing condition of the chuck and a non-squeezing condition thereof; and an air bag for applying a back pressure on the semiconductor substrate, which is held by the chuck in the squeezing condition, in such a manner that a region of the air bag corresponding to the central region of the semiconductor substrate is most swelled out; and air bag inflating/contracting means for inflating or contracting the air bag.

According to this adhesion apparatus of the third aspect, since the adhesion methods set forth in the first and second aspects can be executed, bubbles are hard to be mixed-in the adhesive material. As a result, a flatness level after polishing is improved.

DETAILED DESCRIPTION OF THE INVENTION

Figure 1:
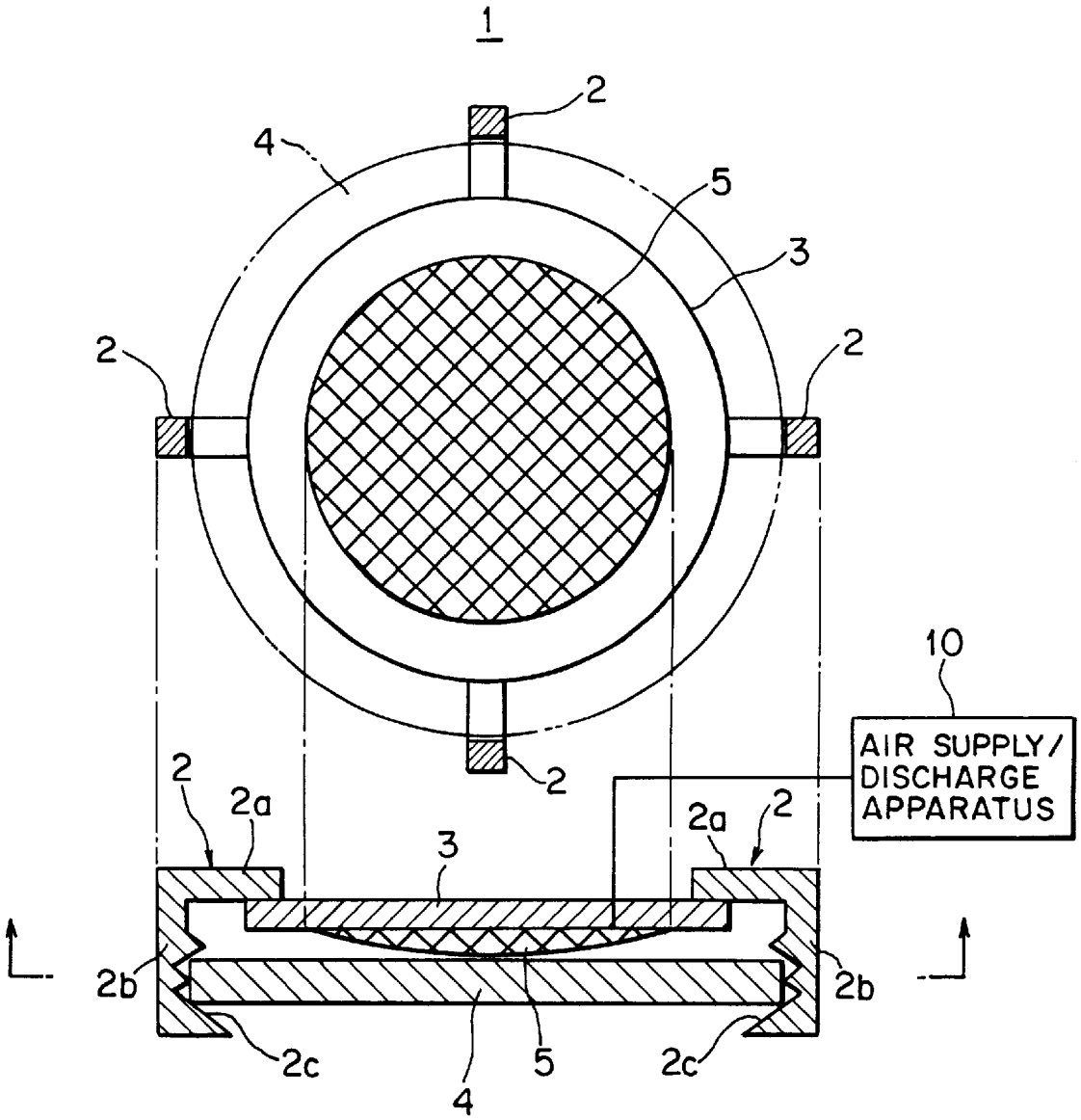
FIG. 1 is a cross sectional view of an adhesion apparatus according to the present invention.

In FIG. 1, an embodiment of an adhesion apparatus according to the present invention is shown. The adhesion apparatus 1 comprises four chucks 2.

A chuck 2, though it is not especially limited, comprises: a horizontal portion 2*a* extending along a radial direction of a mounting plate 3; and a vertical portion 2*b* extending downwardly from an end of the horizontal portion 2*a*, which as a whole has the sectional shape of a hook. A protruding region 2*c* is formed on the inside of the vertical portion 2*b* and a semiconductor substrate 3 is held by the protruding region 2*c*.

Figure 2:
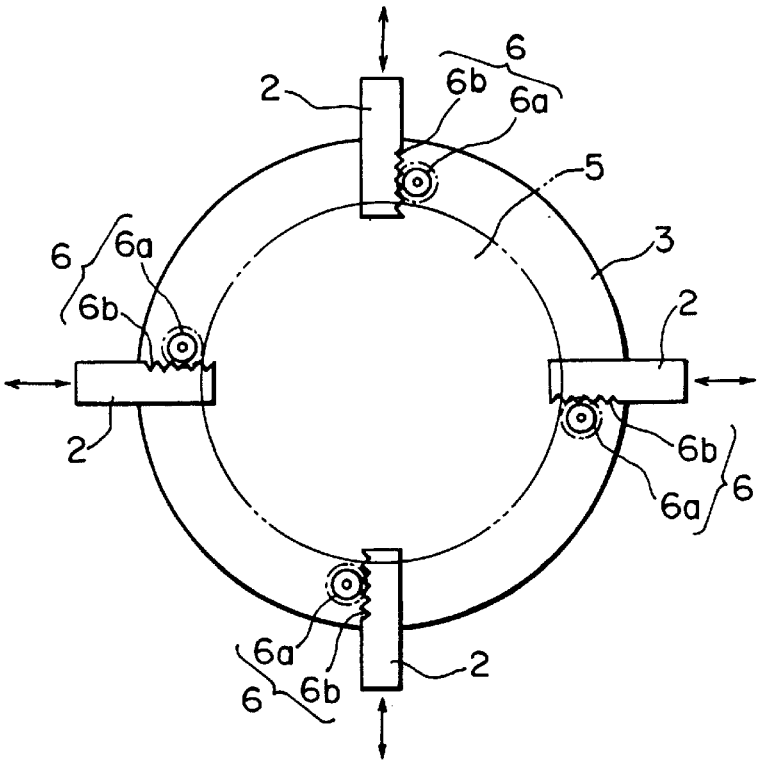
FIG. 2 is a view showing a chuck drive means of an adhesion apparatus according to the present invention.
Figure 3:
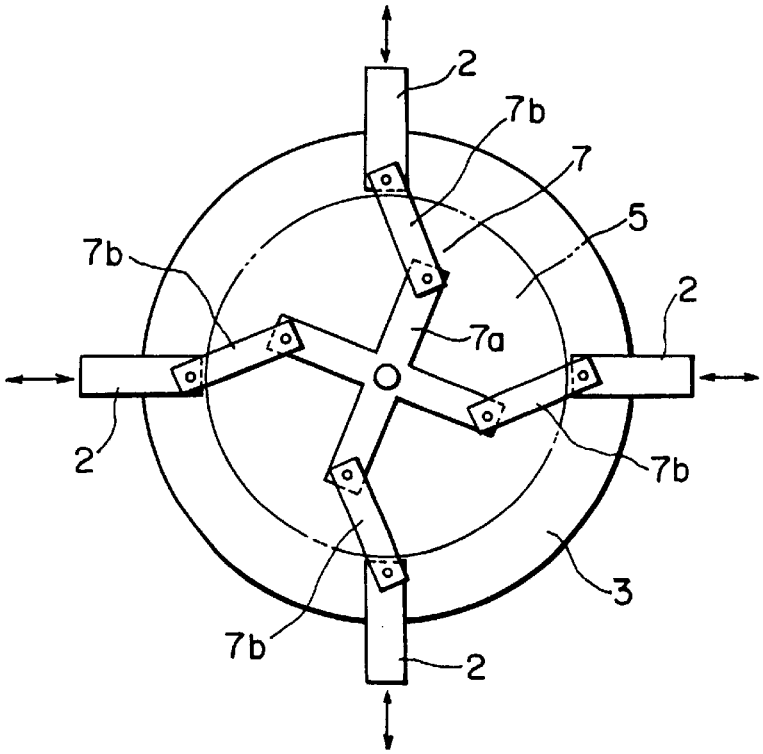
FIG. 3 is a view showing a chuck drive means of an adhesion apparatus according to the present invention.
Figure 4:
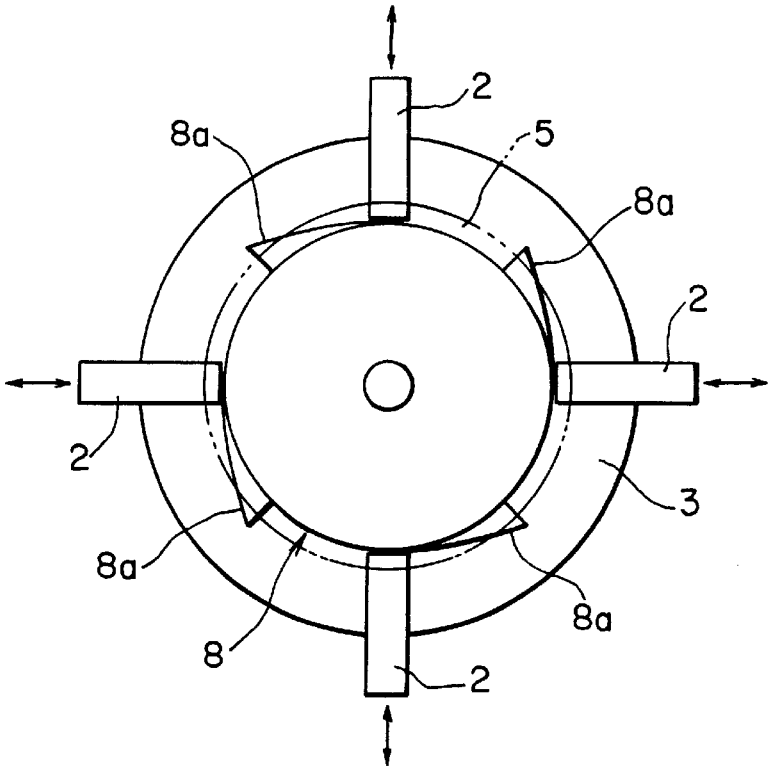
FIG. 4 is a view showing a chuck drive means of an adhesion apparatus according to the present invention.
Figure 5:
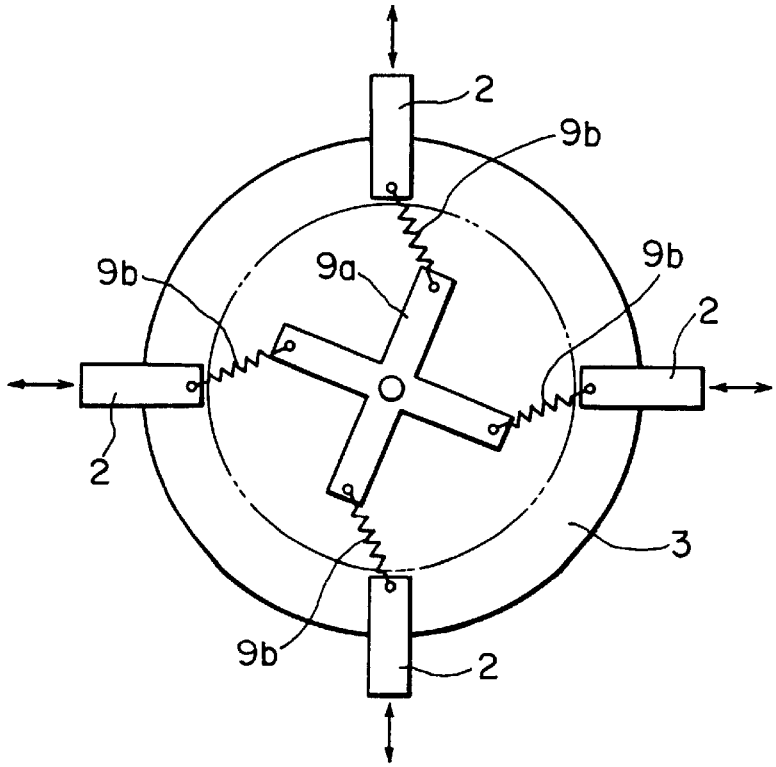
FIG. 5 is a view showing a chuck drive means of an adhesion apparatus according to the present invention.

The chuck 2 can be in reciprocating manner moved along a radial direction of the mounting plate 3. The chuck 2 is connected to a power source, such as a motor, an air pressure apparatus, a hydraulic apparatus or the like with a gear mechanism linkage or a cam mechanism, or a combination thereof interposing therebetween. In FIG. 2, there is shown an example in which a gear mechanism including a pinion 6*a* and a rack 6*b* is used, and in FIG. 3, there is shown an example in which a linkage 7 including a link 7*a* in the shape of a cross and a short link 7*b* is used; in FIG. 4, there is shown an example in which a cam mechanism having four protrusions 8*a* each in the shape of a fin and a driver is used and in FIG. 5, there is shown an example in which a mechanism comprising a body 9*a* of rotation in the shape of a cross and chucks 2 connected by springs 9*a* is used. In the case where the cam mechanism 8 of FIG. 4 is used, it is preferred that an end of each chuck 2 has to be in constant contact with the driver by a spring not shown.

An air bag 5 is mounted on a lower surface of the mounting plate 3 in the central region of the four chucks 2. The air bag 5 is designed to inflate or contract with freedom. The air bag is connected to an air supply/discharge apparatus 10 (FIG. 1), supply and discharge of air by the air supply/discharge apparatus 10 inflates and contracts the air bag 5. The semiconductor substrate 4, which is held by protrusion regions 2*c* of the four chucks 2 in a squeezing condition, is deformed so as to form a curved surface in the central region by inflation of the air bag 5. The deformation in this case, for example, is preferably on the order of 2 to 4 mm for a semiconductor substrate 4 of a diameter of 200 mm. If a magnitude of the deformation is less than 2 mm, there is a fear that bubbles in an adhesive material are not sufficiently pushed out and on the other hand if a magnitude of the deformation is in excess of 4 mm, there is a fear that breakdown of a semiconductor substrate or the like occurs. It is required to mind that a preferable range of the deformation is changed according to a thickness of the semiconductor substrate 4 and a diameter thereof Needless to say that in the case where the semiconductor substrate 4 is deformed by the air bag 5, a height of the vertical portion 2*b* of a chuck 2 is required to be selected, so that the central region of the semiconductor substrate 4 is pressed to the support block 11.

An example of an adhesion method executed in the aforementioned apparatus will be described.

Figure 6A:
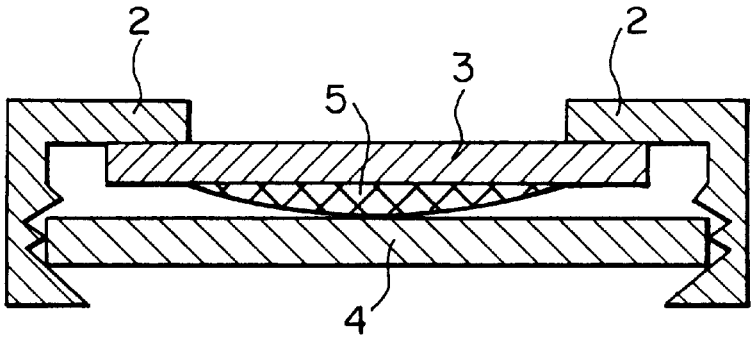
FIGS. 6*a*, 6*b*, 6*c* are views illustrating an example of an adhesion method in an adhesion apparatus according to the present invention.
Figure 6B:
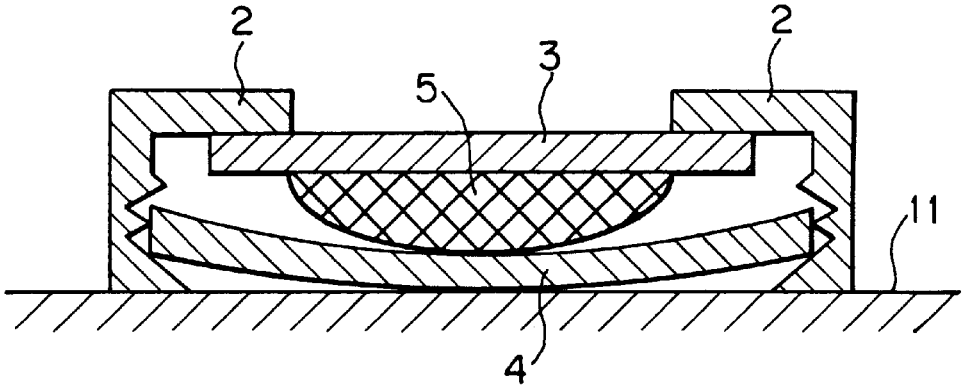
Figure 6C:
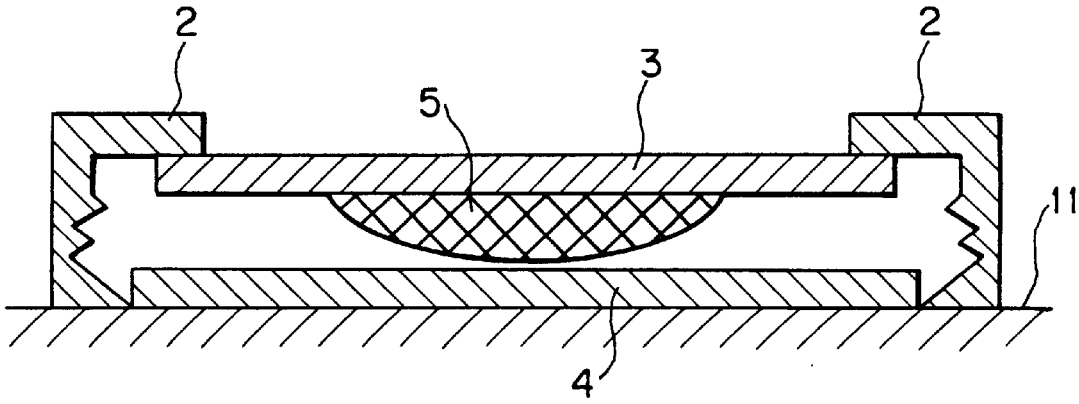

An adhesive material (not shown) is applied on a surface of the semiconductor substrate 4 and the semiconductor substrate 4 with the adhesive material applied thereon is held by the chucks 2 in a squeezing condition (FIG. 6(*a*)). In this case, a lower surface of the semiconductor substrate 4 is applied with the adhesive material. The adhesive material may be applied on a support block 11 instead of applying the adhesive material on the semiconductor substrate 4.

Then, the mounting plate 3 is moved so that the semiconductor substrate 4 has a position directly above the support block 11. The mounting plate 3 is shifted down to have the lower ends of the chucks 2 touch the support block 11. The air bag 5 is inflated and the central region of the semiconductor substrate 4 is pressed to the support block 11 (FIG. 6(*b*)). At this point, the support block 11 is already heated and the adhesive material is molten.

Thereafter, the chucks 2 are opened and the squeezing condition by the chucks of the semiconductor substrate 4 is released and the semiconductor substrate 4 is made to adhere to the support block 11 with the help of a elasticity restoring force of the semiconductor substrate 4 (FIG. 6(*c*)).

According to this adhesion method, since the semiconductor substrate 4 is curved by applying the back pressure with the air bag 5 and thereby minute concave or convex portions do not arise on the semiconductor substrate 4, which is different from the case where vacuum chucking is employed, bubbles are hard to be mixed in the adhesive material. As a result, a flatness level after polishing is improved.

Another example of an adhesion method executed in the aforementioned apparatus will be described.

Figure 7A:
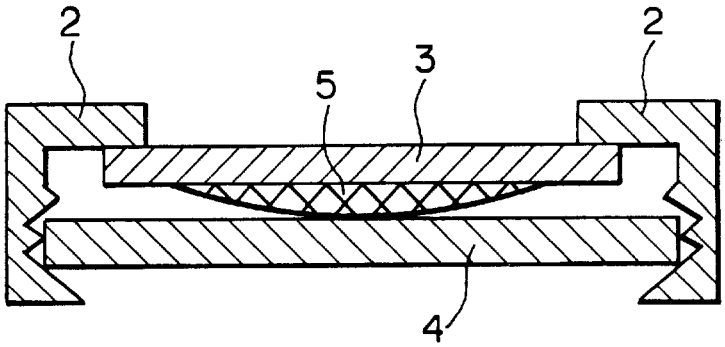
FIGS. 7*a*, 7*b*, 7*c* are views illustrating another example of an adhesion method in an adhesion apparatus according to the present invention.
Figure 7B:
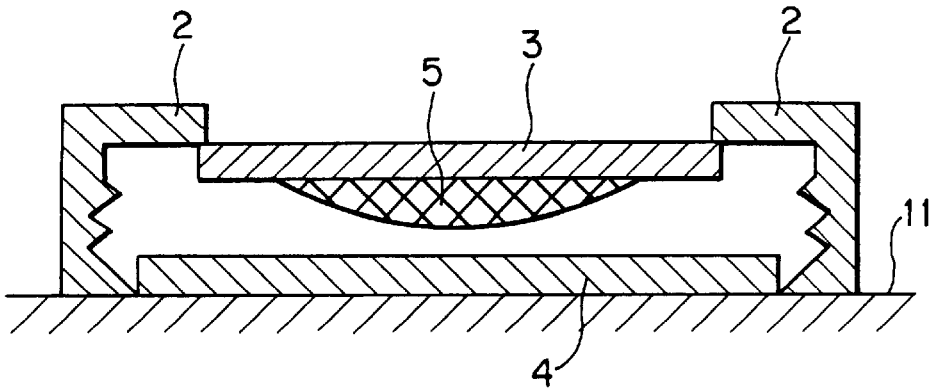
Figure 7C:
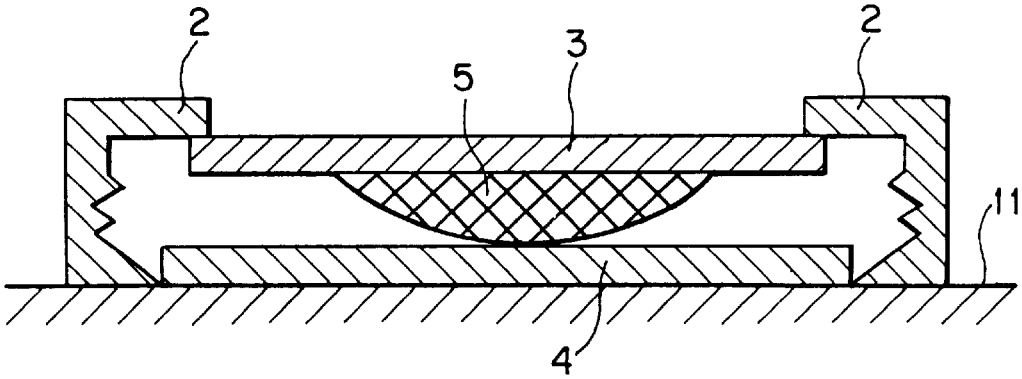
Figure 8:
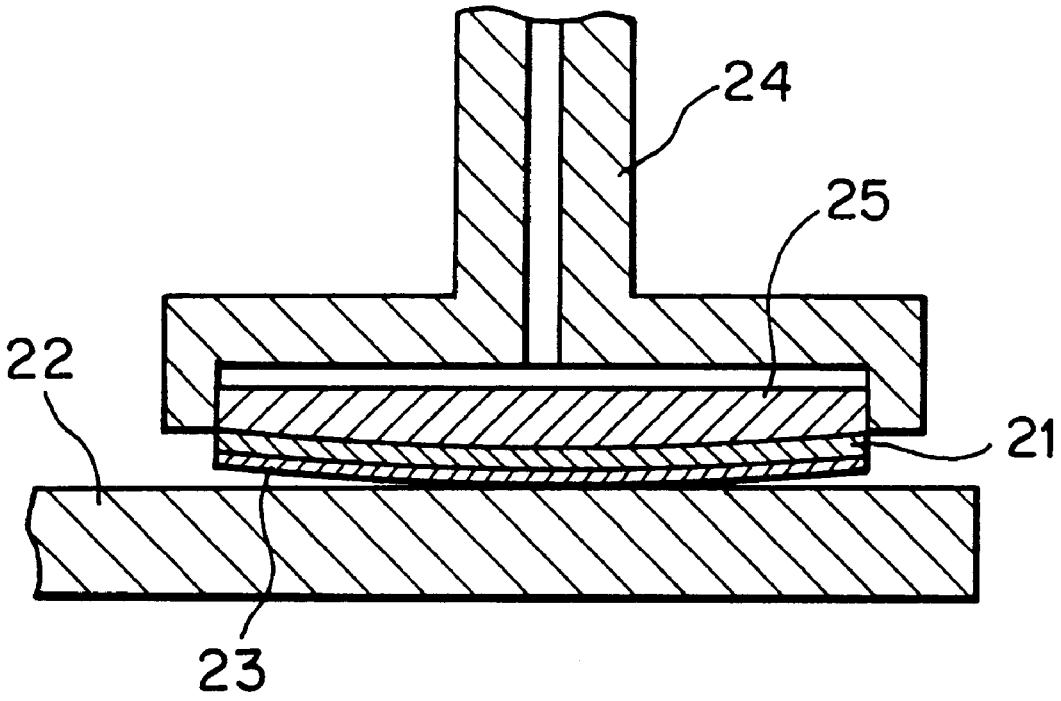
PRIOR ART FIG. 8
FIG. 8 is a view illustrating a conventional adhesion method.

The semiconductor substrate 4 with the adhesive material applied thereon is held by the chucks 2 in a squeezing condition (FIG. 7(*a*)). In this case, a lower surface of the semiconductor substrate 4 is applied with the adhesive material. The adhesive material may be applied on a support block 11 instead of applying the adhesive material on the semiconductor substrate 4.

Then, the mounting plate 3 is moved so that the semiconductor substrate 4 has a position directly above the support block 11. The mounting plate 3 is shifted down to have the lower ends of the chucks 2 touch the support block 11. At this point, the support block 11 is already heated and the adhesive material is molten.

Thereafter, the chucks 2 are opened and the squeezing condition by the chucks of the semiconductor substrate 4 is released and the semiconductor substrate is let to freely fall on the support block (FIG. 7 (*b*)) and a back pressure is applied on the semiconductor substrate and by a back pressure of the air bag 5 the semiconductor substrate 4 is made to adhere to the support block (FIG. 7 (*c*)).

According to this adhesion method, since the semiconductor substrate 4 is held at its periphery in a squeezing condition, the squeezing condition of the semiconductor substrate 4 is released, the semiconductor substrate is let to freely fall, a back pressure is applied on the semiconductor substrate 4 to be made to adhere and thereby minute concave or convex portions do not arise on the semiconductor substrate 4, which is different from the case where vacuum chucking is employed, bubbles are hard to be mixed-in the adhesive material. As a result, a flatness level after polishing is improved.

While the embodiments of the present invention has been described above, the present invention is not limited to the embodiments but various modification of or changes in those can be made without departing from the scope of the present invention.

According to typical features of the present invention, in an adhesion method for a semiconductor substrate on a support block with an adhesive material, since not only is the semiconductor substrate supported at its periphery in a squeezing condition but a back pressure is also applied on the semiconductor substrate with an air bag in such a manner that a region of the air bag corresponding to the central region of the semiconductor substrate is most swelled out, so that the semiconductor substrate is curved and the central region of the semiconductor substrate is pressed to the support block and thereafter, the squeezing condition of the semiconductor substrate is released to make the semiconductor substrate adhered to the support block, bubbles are hard to be mixed-in the adhesive material. As a result, a flatness level after polishing is improved.

What is claimed is:

1. An adhesion method for a semiconductor substrate on a support block with an adhesive material, is characterized in that not only is the semiconductor substrate supported at its periphery in a squeezing condition but a back pressure is also applied on the semiconductor substrate with an air bag in such a manner that a region of the air bag corresponding to the central region of the semiconductor substrate is most swelled out, so that the semiconductor substrate is curved and the central portion of the semiconductor substrate is pressed to the support block and that thereafter, the squeezing condition of the semiconductor substrate is released to make the semiconductor substrate adhered to the support block.

2. An adhesion method for a semiconductor substrate on a support block with an adhesive material, is characterized in that the semiconductor substrate is supported at its periphery in a squeezing condition, that the squeezing condition of the semiconductor substrate is released to have the semiconductor substrate fall on the support block by its self weight, that thereafter a back pressure is applied on the semiconductor substrate with an air bag in such a manner that a region of the air bag corresponding to the central region of the semiconductor substrate is most swelled out and that thereby the semiconductor substrate is made to adhere to the support block.

3. An adhesion apparatus for a semiconductor substrate on a support block with an adhesive material, comprising: a chuck for holding the semiconductor substrate at its periphery in a squeezing condition; chuck drive means for driving the chuck to convert between the squeezing condition of the chuck and a non-squeezing condition thereof; and an air bag for applying a back pressure on the semiconductor substrate, which is held by the chuck in a squeezing condition, in such a manner that a region of the air bag corresponding to the central region of the semiconductor substrate is most swelled out; and air bag inflating/contracting means for inflating or contracting the air bag.

* * * * *